United States Patent [19]

Wolf

[11] 4,188,851

[45] Feb. 19, 1980

[54] STRAP LATCHING DEVICE

[76] Inventor: Eric N. Wolf, 3000 Biloxi Ct., Louisville, Ky. 40205

[21] Appl. No.: 934,605

[22] Filed: Aug. 17, 1978

[51] Int. Cl.[2] ..... G10G 5/00

[52] U.S. Cl. ..... 84/327; 24/224; 224/910

[58] Field of Search ..... 24/208 A, 216, 211 R, 24/217, 224 R; 84/327; 224/252, 269, 910

[56] References Cited

U.S. PATENT DOCUMENTS

| | | | |
|---|---|---|---|
| 278,430 | 5/1883 | Henius | 24/224 R |
| 3,323,698 | 6/1967 | Sottile | 224/910 X |
| 3,688,012 | 8/1972 | Vettel | 84/327 |

*Primary Examiner*—Lawrence R. Franklin

*Attorney, Agent, or Firm*—Charles G. Lamb

[57] ABSTRACT

A latching device for latching a strap to an object, the latching device being a flat, flexible, material with a slotted opening therein adapted for engagement with a button or similar engaging device on the object with the strap being disposed and held therebetween.

6 Claims, 3 Drawing Figures

STRAP LATCHING DEVICE

BACKGROUND OF THE INVENTION

1. Field of the Invention

This invention relates to a locking device and particularly relates to a strap locking device for guitar straps and straps of other similar stringed instruments.

2. Description of the Prior Art

In the fastening of straps to objects, particularly a guitar strap to a guitar, many times, due to movement of the strap, the strap becomes loosened from the object to which it is attached. In the case of a guitar strap which goes across the shoulders of a player, when the strap comes unfastened from the button to which it is attached, the guitar is liable to fall and in many instances is damaged.

Presently, there are several means commercially available for locking a strap to a guitar, but they are complex and relatively expensive. In fact, one presently commercially available strap locking device requires removing of standard strap buttons from the object (guitar) to which the locking device is to be placed and then replacing with special fixtures of the locking device.

SUMMARY OF THE INVENTION

In the present invention, it is recognized that it is desirable to provide a latch for a strap, particularly a shoulder strap for a guitar, which is inexpensive, but yet is reliable and easy to utilize in locking a strap to an object to which the strap is applied.

The present invention advantageously provides a straightforward arrangement for a latch for a strap which may be used with detachable straps for objects which are to be carried, such as shoulder straps detachably connected to a guitar. The present invention further provides a strap latching device that is inexpensive, sturdy, easy and quickly operable, and reliable for holding the strap when the object and strap are subjected to movement.

Various other features of the present invention will become obvious to those skilled in the art upon reading the disclosure set forth hereinafter.

More particularly, the present invention provides a strap locking device comprising a flat plate member with a slotted opening therein, the opening being of preselected size for engaging with a button of an object to which said latching device is to be applied.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE INVENTION

Referring to the drawing.

DESCRIPTION OF THE PREFERRED EMBODIMENTS

Figure 1:
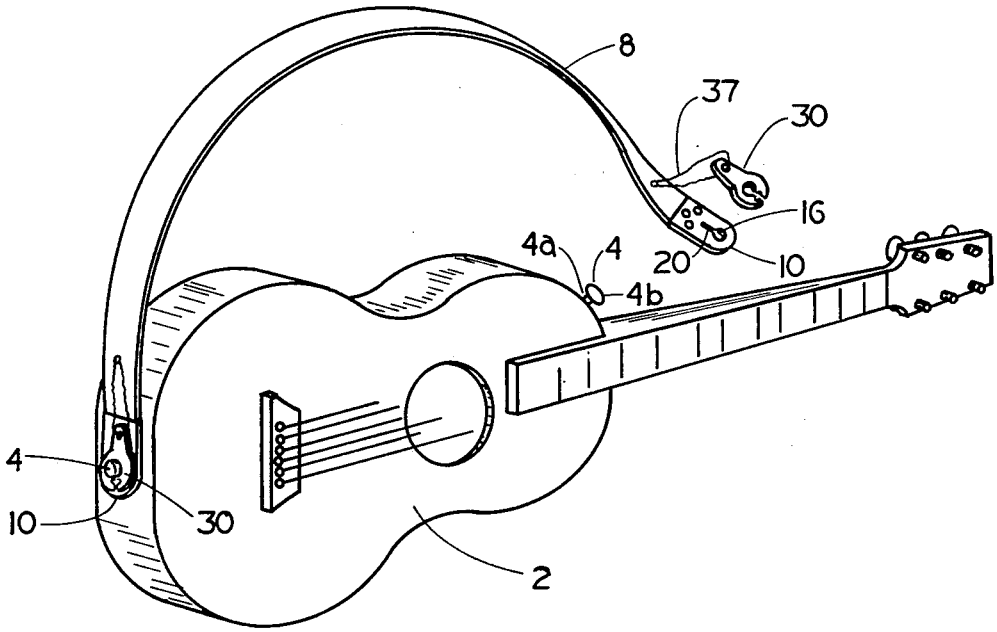
FIG. 1 is a perspective view of a preferred strap latching device of the present invention when utilized with a shoulder strap for a guitar.

In the embodiment of the invention selected for illustration in FIG. 1, a standard guitar 2 is provided with a pair of buttons 4. Buttons 4 are provided with base portions **4*a* which are smaller in diameter than the knob portion 4*b*, base portions 4*a* being vertically elongated to receive appropriate portions of strap 8 to be discussed hereinafter. The guitar strap 8 is usually leather, vinyl, cloth, or the like with covered ends 10. The covered ends 10 are generally reinforced leather or other resistant materials which are flexible. Covered ends 10 are provided with apertures 16 therein with slits 20 for engagement with buttons 4**.

Figure 2:
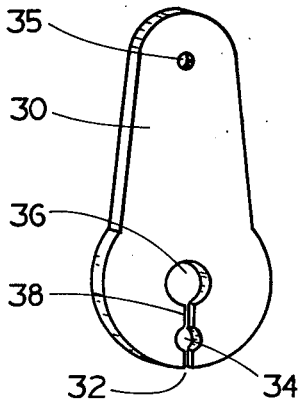
FIG. 2 is an enlarged perspective view of the strap latching device shown in FIG. 1; and, FIG. 3 is a perspective view of another preferred strap latching device of the present invention.

A strap holding device 30 is provided to fit over the ends 10 of the strap 8 and engage with the buttons 4 as discussed hereinafter. The strap holding device 30, as best shown in FIG. 2, is generally a flat piece of flexible plastic material cut into a desired configuration, such as the configuration shown. It is realized that other materials and shapes may be used as long as the material has sufficient strength and flexibility in use, the exact shape and material being dependent upon the use for which the device is intended.

The device 30 is provided with a slit 32 therein, slit 32 terminating in an enlarged opening 34. Another enlarged opening 36, of substantially circular configuration larger than opening 34, is provided with a slit 38 connecting therebetween. Slits 32 and 38 have widths slightly less than the base portion **4*a* so that upon engagement with buttons 4 slits 32 and 38 must be spread apart. Once the base 4*a* is in place in the opening 36, the slits 32 and 38 return to their original position and are thereby positioned to prevent accidental removal from the button 4 upon movement of the strap 8 and the guitar 2. Also, opening 36 is of preselected size sufficient to receive the base portion 4*a*, but less than the diameter of the knob portion 4*b*, so that the device 30 cannot be removed from the button 4 over the knob portion 4*b*. It has been found that by using a pair of openings 34 and 36, the extra or intermediate opening 34 relieves the stress during spreading of the slits 32 and 38 thereby assisting in the engaging of the device 30 with button 4. It is realized that other configurations as well as additional enlarged openings may also be used for relieving stress. Also, an aperture 35 may also be provided to receive a string 37 (FIG. 1) therethrough for permanent attachment by any known means to the strap 8**.

Figure 3:
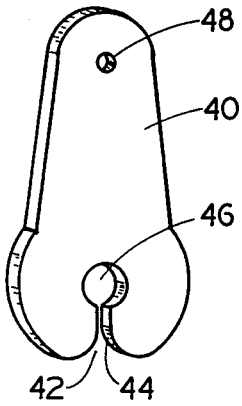

Another preferred strap holding device is shown in FIG. 3. In FIG. 3, a strap holding device 40 is shown as a substantially flat piece of flexible plastic with a slotted opening 42 therein. Slotted opening 42 includes an elongated portion defined by opposed sides 44 which diverge outwardly, from an enlarged substantially circular opening 46. By diverging outwardly, upon engagement with the base portion **4*a*, this provides guidance means along which the base portion 4*a* slides toward the enlarged portion of the opening 42. Also provided is an aperture 48** to receive a string, wire, or the like therethrough for attaching to a strap (not shown).

It is realized that other configurations, shapes, sizes, and the like, of latching devices may be used without departing from the scope and spirit of the present invention.

It is claimed:

1. In an arrangement for latching a strap to a button of an object, the strap having an opening therein engageable with the button, the button having a base portion and a knob portion wherein the base portion is smaller in diameter than the knob portion a latching device comprising a flat plate member with a slotted opening therein, the opening being of preselected size smaller than the knob of the button and engageable with the base of the button with the strap being disposed between the latching device and the object and attached to said button, said slotted opening includes a slit terminating in a first enlarged opening, the slit being at least at one point narrower in width than the base of the button, the opening being of preselected size sufficient to receive the base of the button and smaller than the knob of the button.

2. In an arrangement of claim 1, said slit including a second enlarged opening therein, said second opening being smaller than said first opening.

3. In an arrangement of claim 2, said openings being circular.

4. In an arrangement of claim 1, said slit defined by opposed sides diverging outwardly from said first enlarged opening.

5. In an arrangement of claim 1 wherein said object is a guitar.

6. In an arrangement of claim 5 wherein said strap is a guitar strap.

* * * * *